US007572129B2

(12) United States Patent
Fan

(10) Patent No.: US 7,572,129 B2
(45) Date of Patent: Aug. 11, 2009

(54) ELECTRICAL CONNECTOR ASSEMBLY

(75) Inventor: Chia-Wei Fan, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,977

(22) Filed: Aug. 18, 2008

(65) Prior Publication Data

US 2009/0047811 A1 Feb. 19, 2009

(30) Foreign Application Priority Data

Aug. 17, 2007 (CN) ..... 2007 2 0042943 U

(51) Int. Cl.
*H01R 4/50* (2006.01)

(52) U.S. Cl. ..... 439/73; 439/331

(58) Field of Classification Search ..... 439/73, 439/331, 71, 72, 525, 526
See application file for complete search history.

(56) References Cited

U.S. PATENT DOCUMENTS 7,021,954 B2 * 4/2006 Gattuso et al. ..... 439/342
7,083,430 B2 * 8/2006 Liao et al. ..... 439/73
7,160,130 B2 * 1/2007 Ma ..... 439/331
7,241,161 B2 * 7/2007 Mar ..... 439/331
7,278,860 B2 * 10/2007 Ma ..... 439/73
7,402,065 B1 * 7/2008 Polnyi ..... 439/331
2003/0036301 A1 * 2/2003 Colbert et al. ..... 439/331

* cited by examiner

*Primary Examiner*—Gary F. Paumen
(74) *Attorney, Agent, or Firm*—Wei Te Chung

(57) ABSTRACT

An electrical connector assembly (100) comprises an electrical connector for connecting an electronic package with a circuit substrate (4) and including an stiffener (1) defining a through hole (121) in a periphery, a fastening device (3) for fixing the electrical connector to the circuit substrate (4) via the corresponding through hole (121), a hollow restricting device (2) defining a plurality of protruding portions (24) interferencing with the fastening device (3) make the fastening device (3) securely located on the stiffener (1). At the same time, the restricting device (2) located between the stiffener (1) and the circuit substrate (4) function as a standoff, make it more easy to assemble the stiffener (1) to the circuit substrate (4).

12 Claims, 6 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly having improved connecting device for fixing the electrical connector with other member, such as a printed circuit board (PCB).

2. Description of the Prior Art

Electrical connectors are widely used in electrically connecting electronic packages, such as Land Grid Array (LGA) Central Processing Units (CPU), with circuit substrate, such as printed circuit boards (PCB).

Referring to FIG. 6, a conventional electrical connector assembly 100' is illustrated. The electrical connector assembly 100' comprises an electrical connector 6' for electrically connecting a CPU 5' with a PCB 7', a number of screws 8' and nuts 9'. The electrical connector 6' comprises a number of first holes 61' and the PCB 7' comprises a number of second holes 71' accordingly to the first holes 61'. When the electrical connector 6' is assembled to the PCB 7', first assemble the screw 8' to the electrical connector 6', and the screw 8' goes through the first holes 61' and the second holes 71', then put the nut 9' matched with the screw 8'. Thus make the electrical connector 6' securely fastened with the PCB 7'.

As the miniaturization development of the electrical connector, the screw and the nut become smaller relatively, so when shipped or before assembled, they are easily lost. Thus make a inconvenience when assembled the electrical connector to the PCB.

In view of the above, a new electrical connector assembly that overcomes the above-mentioned disadvantages is desired.

SUMMARY OF THE INVENTION

Accordingly, an object of the present invention is to provide an electrical connector assembly that can securely locating the fastening device on the electrical connector.

To fulfill the above-mentioned object, an electrical connector assembly in accordance with a preferred embodiment of the present invention, comprises an electrical connector for connecting an electronic package with a circuit substrate and including an stiffener defining a through hole in a periphery, a fastening device for fixing the electrical connector to the circuit substrate via the corresponding hole, a hollow restricting device defining a plurality of protruding portions interferencing with the fastening device for restricting the fastening device on the electrical connector.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
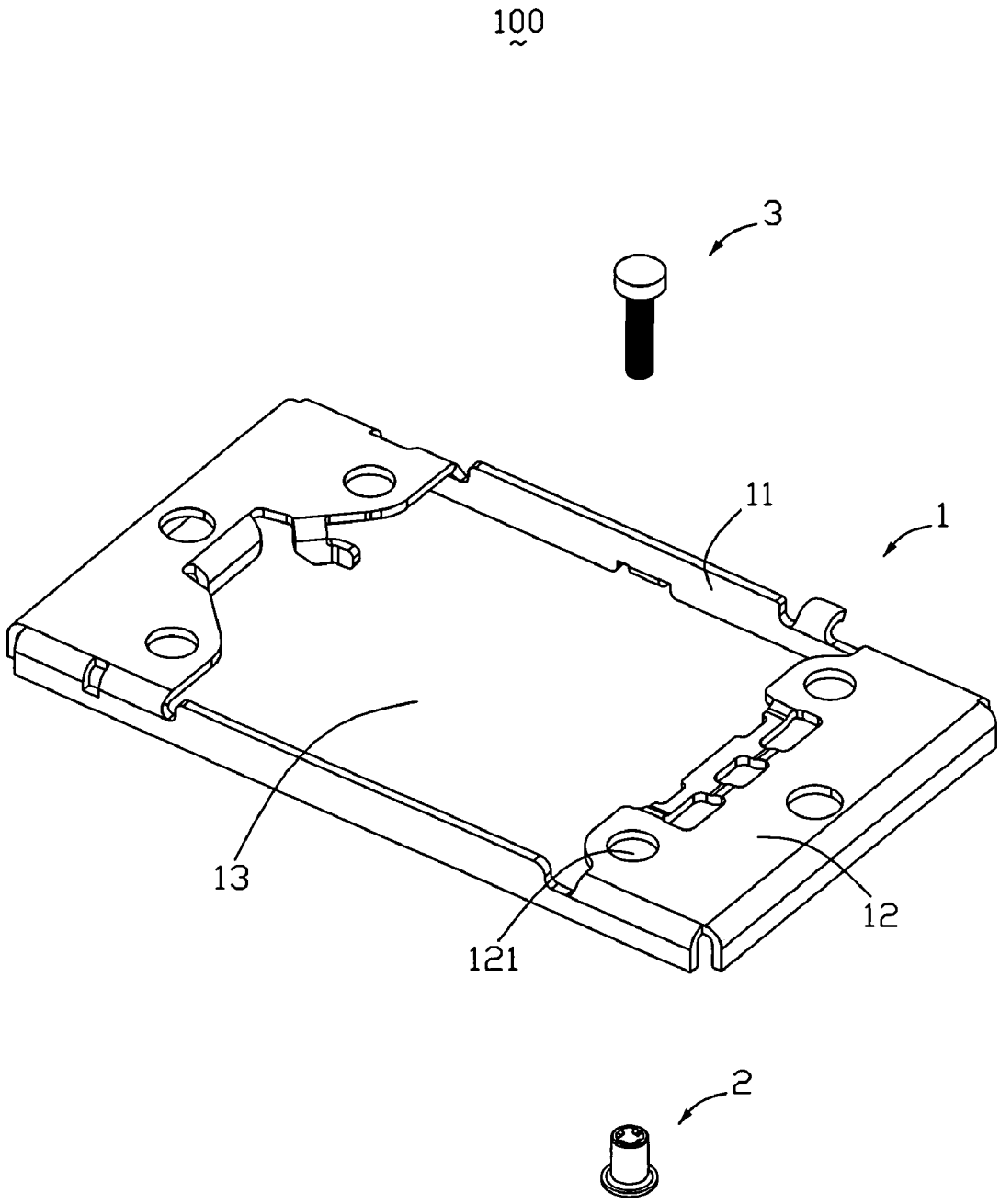
FIG. 1 is an exploded view of an electrical connector assembly of the first embodiment of the present invention, only showing a stiffener, a fastening device and a restricting device.
Figure 3:
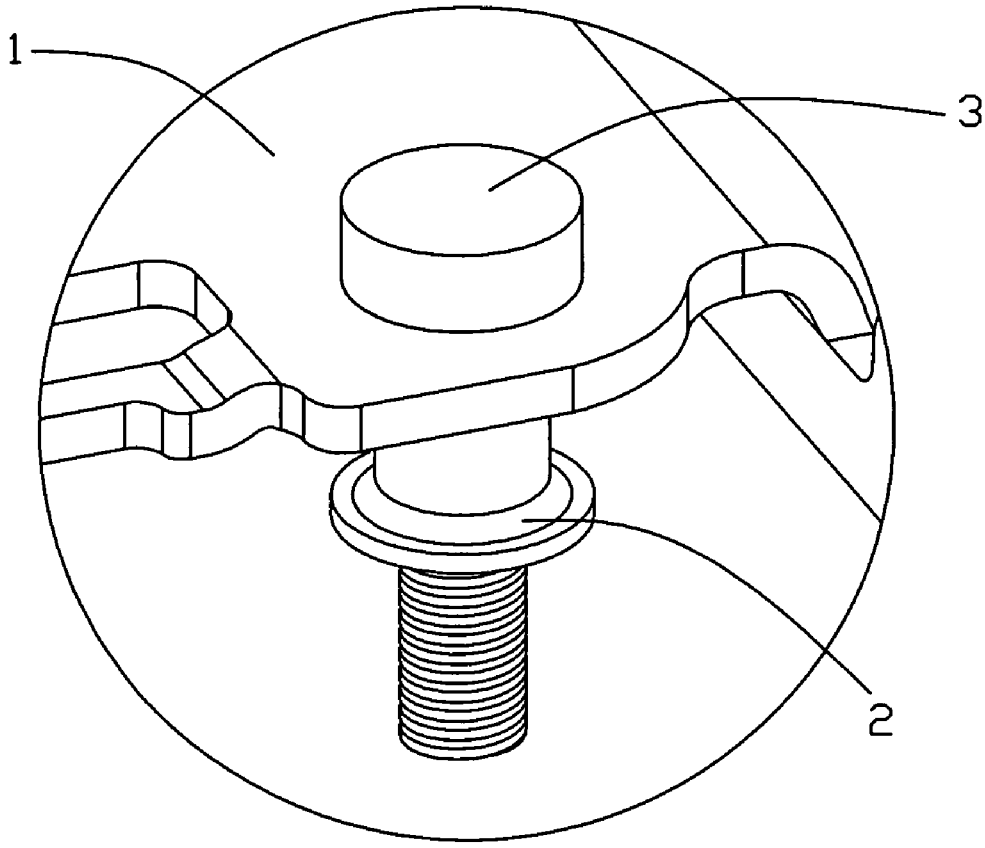
FIG. 3 is a partially enlarged view of the electrical connector assembly of FIG. 1, showing the fastening device and the restricting device assembled to the stiffener.
Figure 4:
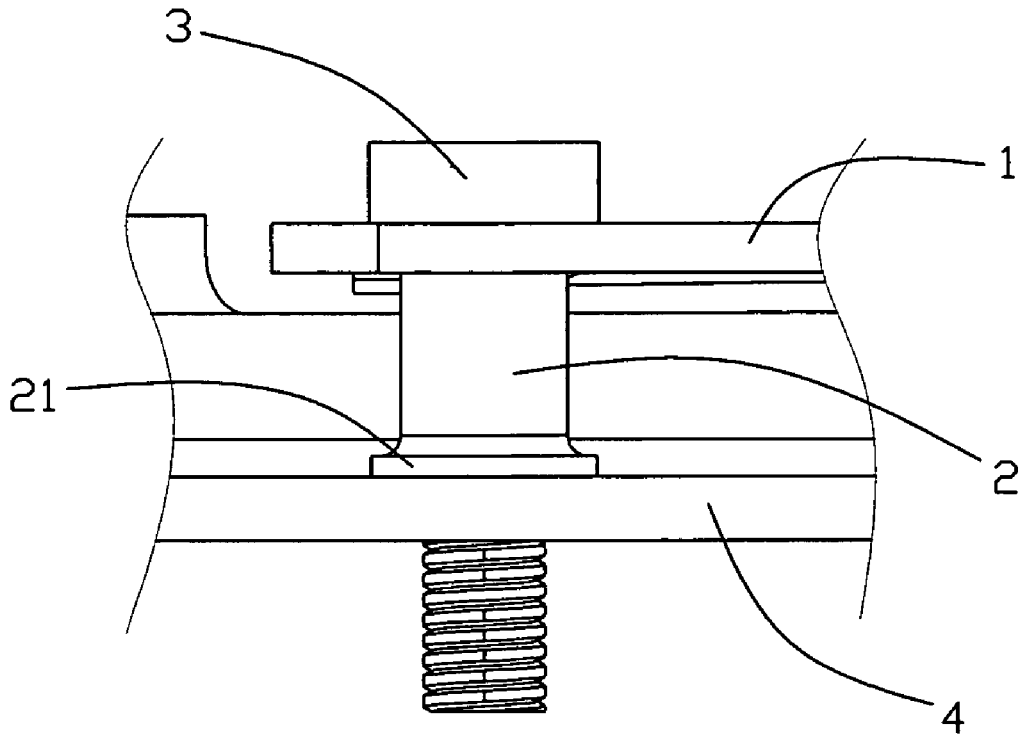
FIG. 4 is another view of the electrical connector assembly of FIG. 3, showing the electrical connector assembly be assembled on the printed circuit board.

Referring to FIG. 1, FIG. 3 and FIG. 4, an electrical connector assembly 100 comprises an electrical connector (not labeled) for electrically connecting an electronic package, such as an central processing unit (CPU) (not shown), with a circuit substrate, such as a printed circuit board (PCB) 4, a fastening device 3 and a restricting device 2.

The electrical connector comprises a metal stiffener 1. The stiffener 1 comprises a pair of long sides 11, a pair of short sides 12 and a window 13 formed by the long sides 11 and the short sides 12. The stiffener 1 also defines a plurality of through holes 121 in the periphery of the two short sides 12. The PCB 4 comprises a number of apertures (not labeled) corresponding to the through holes 14. In this embodiment of the invention, the fastening device 3 is a screw going through the through hole 121 and the aperture to fasten the stiffener 1 on the PCB 4.

Figure 2:
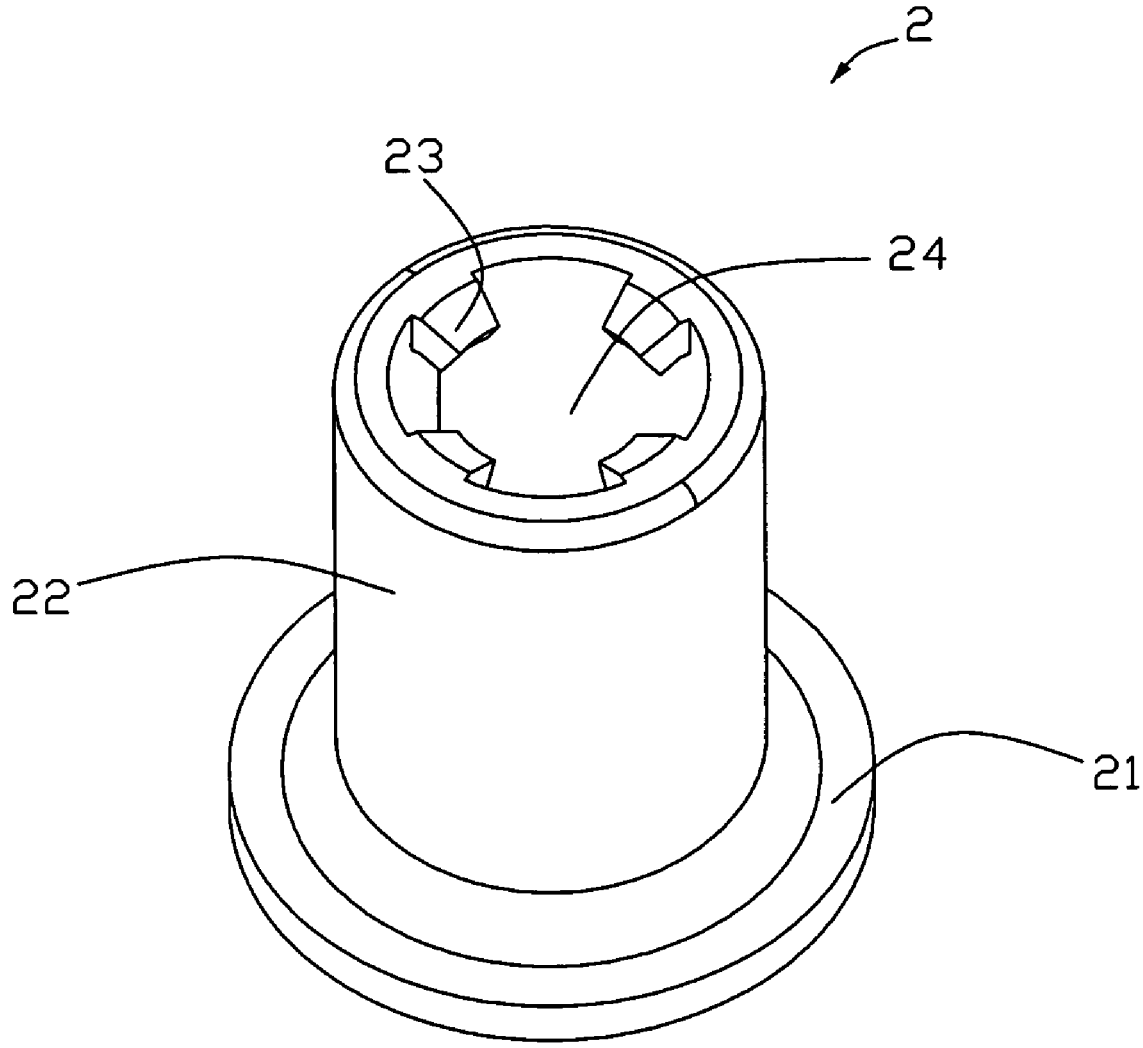
FIG. 2 is an isometric view of the restricting device of FIG. 1.

Referring to FIG. 2, the restricting device 2 comprises a barrel portion 22 and a blocking portion 21. The diameter of the blocking portion 21 is larger than that of the barrel portion 22. The restricting device 2 defines a second through hole 24 go through the barrel portion 22 and the blocking portion 21. In this embodiment, the upper of the barrel portion 22 defines a plurality of protruding portions 23 protruding to the second through holes 2.

Referring to FIG. 3, after the fastening device 3 is assembled to the stiffener 1, assemble the restricting device 2 to the fastening device 3, the protruding portions 23 of the restricting device 2 interference with the fastening device 3, so that the restricting device 2 can securely restrict the fastening device 3 on the stiffener 1.

Referring to FIG. 4, When the stiffener 1 is assembled on the PCB 4, the restricting device 2 is located between the stiffener 1 and the PCB 4 as a stand-off. The restricting device 2 can make it more easy to assemble the stiffener 1 on the PCB 4.

Figure 5:
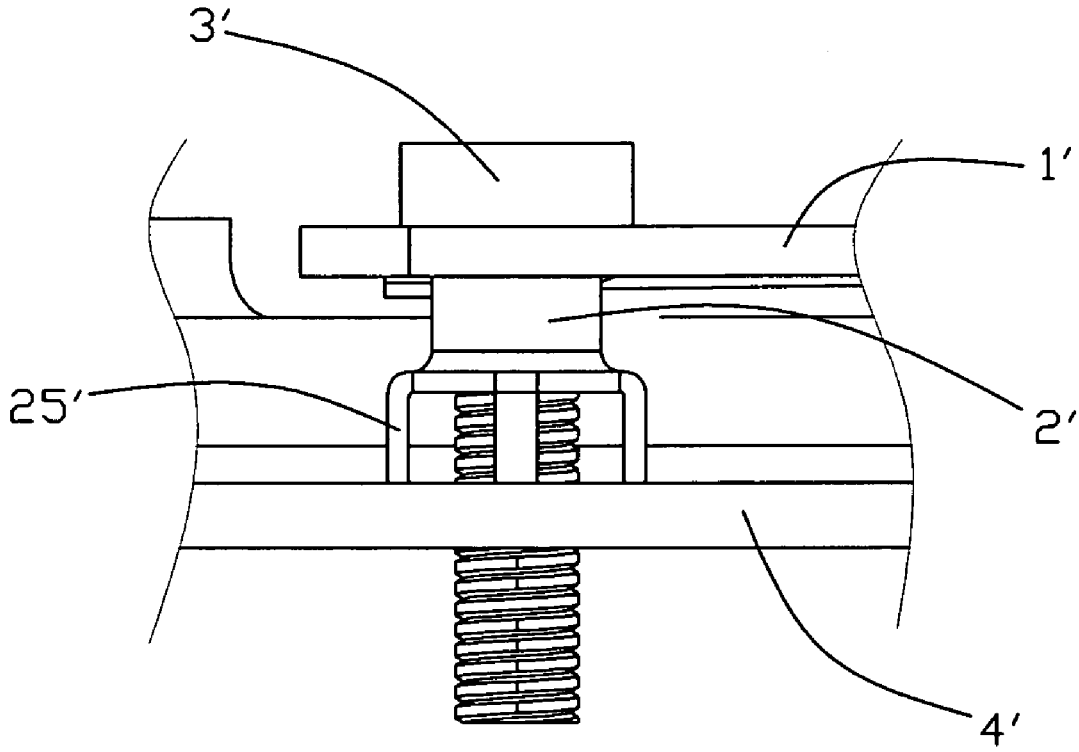
FIG. 5 is an assembly view of a electrical connector assembly of the second embodiment of the present invention, showing the electrical connector assembly be assembled on the printed circuit board.
Figure 6:
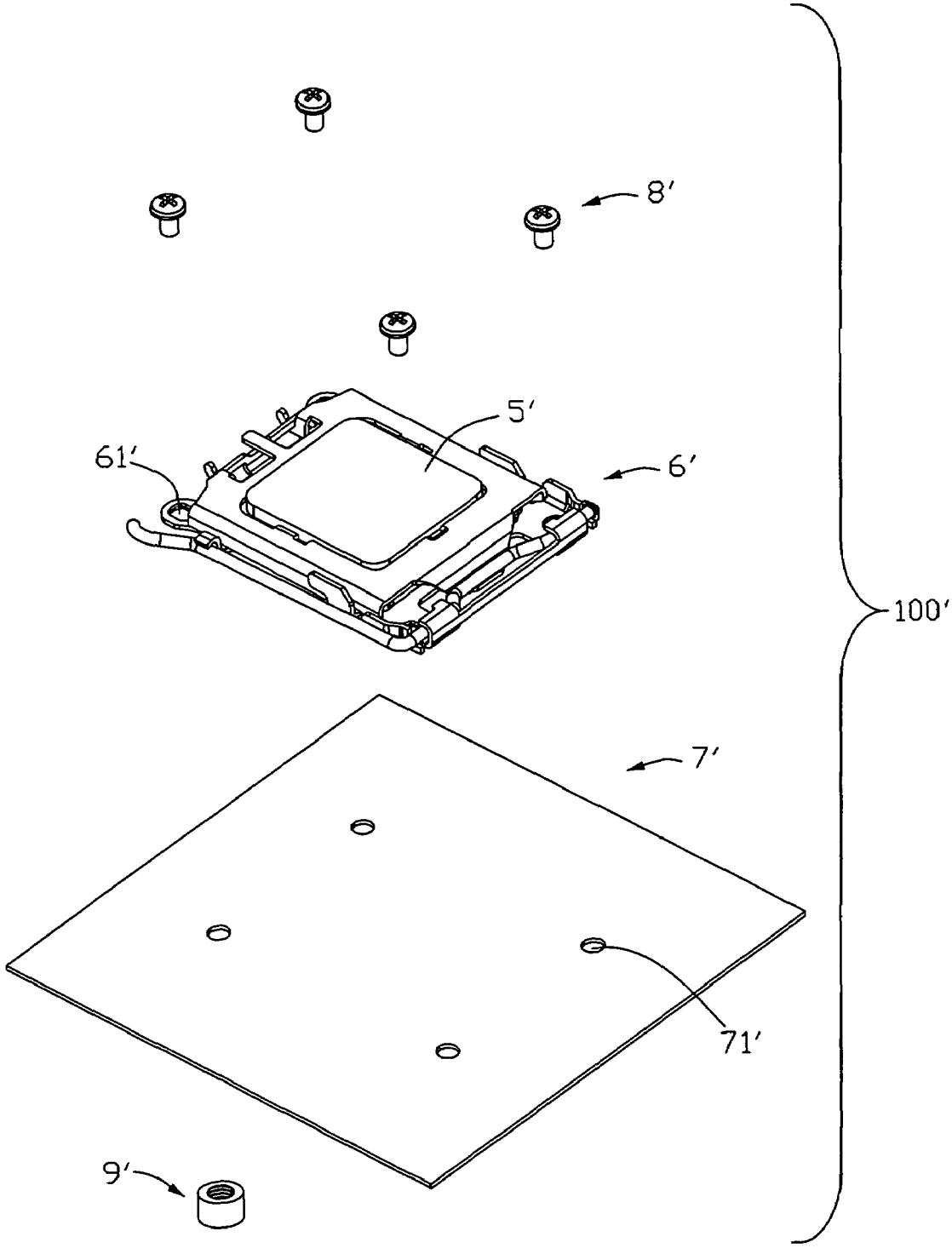
FIG. 6 (PRIOR ART)
FIG. 6 is an exploded view of a conventional electrical connector assembly.

Referring to FIG. 5, showing a second embodiment of the invention, the difference with the first embodiment is the restricting device 2' comprises an extending portion 25' extending downwardly from the blocking portion 21. The extending portion 25' stands on the PCB 4' is formed by a plurality of portions configured with an equality and symmetrical mode.

The restricting device 2, 2' interferencing with the fastening device 3 make the fastening device 3 securely located on the stiffener 1. At the same time, the restricting device 2, 2' located between the stiffener 1 and the PCB 4 as a stand-off, make it more easy to assemble the stiffener 1 to the PCB 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector for connecting an electronic package with a circuit substrate and including a stiffener defining a plurality of through holes in a periphery thereof;

a fastening device for fixing the electrical connector to the circuit substrate via the corresponding through hole; and a hollow restricting device defining a plurality of protruding portions interferencing with the fastening device for restricting the fastening device on the electrical connector, the restricting device comprising a barrel portion and a blocking portion with a diameter larger than that of the barrel portion.

2. The electrical connector assembly as claimed in claim 1, wherein the restricting device comprises an extending portion extending downwardly from the blocking portion.

3. The electrical connector assembly as claimed in claim 2, wherein the extending portion is formed by a plurality of portions configured with an equidistant mode.

4. An electrical connector assembly comprising:

a printed circuited board;

an electrical connector located above the printed circuit board and including a metallic stiffener defining a plurality of through holes in a periphery area;

a fastening device for assembling said stiffener to the printed circuit board; and a hollow restricting device defining a plurality of protruding portions interferencing with the fastening device for restricting the fastening device on the electrical connector, the restricting device fbnctioning as a standoff and is positioned between the stiffener and the printed circuit board.

5. The electrical connector assembly as claimed in claim 4, wherein the restricting device comprises a barrel portion and a blocking portion.

6. The electrical connector assembly as claimed in claim 5, wherein the diameter of the blocking portion is larger than that of the barrel portion.

7. The electrical connector assembly as claimed in claim 6, wherein the blocking portion stands on the printed circuit board.

8. The electrical connector assembly as claimed in claim 7, wherein the restricting device comprises an extending portion extending downwardly from the blocking portion.

9. The electrical connector assembly as claimed in claim 8, wherein the extending portion stands on the printed circuit board is formed by a plurality of portions configured with an equidistant mode.

10. An electrical connector assembly comprising:

a printed circuited board;

a stiffener positioned above the printed circuit board via a standoff;

a screw extending through the stiffener, the standoff and the printed circuit board under a condition that the screw interferes with the standoff.

11. The electrical connector assembly as claimed in claim 10, wherein said standoff defines a plurality of inwardly protruding radial portions for interference with the screw.

12. The electrical connector assembly as claimed in claim 11, wherein said inwardly protruding radial portions are formed at an upper rim of said standoff.

* * * * *